US011622436B2

(12) United States Patent
Sanson

(10) Patent No.: US 11,622,436 B2
(45) Date of Patent: Apr. 4, 2023

(54) DIRECT WIRELESS CONTROL OF LIGHTING SYSTEMS FOR USE IN A HIGH-MOISTURE ENVIRONMENT

(71) Applicant: BELLSON ELECTRIC PTY LTD, Caringbah (AU)

(72) Inventor: David John Sanson, Taren Point (AU)

(73) Assignee: BELLSON ELECTRIC PTY LTD

( * ) Notice: Subject to any disclaimer, the term of this patent is extended or adjusted under 35 U.S.C. 154(b) by 472 days.

(21) Appl. No.: 16/941,182

(22) Filed: Jul. 28, 2020

(65) Prior Publication Data

US 2021/0051787 A1 Feb. 18, 2021

Related U.S. Application Data

(63) Continuation of application No. 16/543,092, filed on Aug. 16, 2019, now Pat. No. 10,681,793.

(30) Foreign Application Priority Data

Jul. 13, 2020 (EP) ..... 20185529

(51) Int. Cl.
*H05B 47/19* (2020.01)
*E04H 4/14* (2006.01)
(Continued)

(52) U.S. Cl.
CPC ..... *H05B 47/19* (2020.01); *E04H 4/148* (2013.01); *F21V 31/00* (2013.01); *H05B 45/10* (2020.01);
(Continued)

(58) Field of Classification Search
CPC ..... H05B 45/10; H05B 45/20; H05B 47/10; H05B 47/19; E04H 4/148; F21V 31/00; F21Y 2115/10; F21W 2131/401
See application file for complete search history.

(56) References Cited

U.S. PATENT DOCUMENTS 4,782,430 A 11/1988 Robbins et al. ..... F21V 7/04
5,135,717 A 8/1992 Renzoni et al. ..... 422/61
(Continued)

FOREIGN PATENT DOCUMENTS

AU 2011338154 6/2016 ..... E04H 4/16
CN 105188230 12/2015 ..... H05B 37/02
(Continued)

OTHER PUBLICATIONS

Examination Report issued in Australian application No. 2020205322, dated Apr. 15, 2021, 6 pgs.
(Continued)

*Primary Examiner* — Haissa Philogene
(74) *Attorney, Agent, or Firm* — Hayes Soloway P.C.

(57) ABSTRACT

A lighting system for use in a high-moisture environment, such as a swimming pool, includes a lighting unit having a housing and at least one light-emitting device positioned within the housing. A power supply provides power to the light-emitting device. A receiver positioned within the housing operates with a LoRa modulation format. A mobile control unit located remote from the lighting unit is configured to transmit at least one wireless control signal to the receiver, whereby the at least one control signal controls or changes a characteristic of the at least one light-emitting device, such as an on/off state, a color, a lighting effect, or a pattern of display. Related systems and methods for installing a lighting system for use in a high-moisture environment are also disclosed.

20 Claims, 12 Drawing Sheets

(51) Int. Cl.

| | |
|---|---|
| ***F21V 31/00*** | (2006.01) |
| ***H05B 45/20*** | (2020.01) |
| ***H05B 45/10*** | (2020.01) |
| *F21Y 115/10* | (2016.01) |
| *F21W 131/401* | (2006.01) |

(52) U.S. Cl.
CPC ..... *H05B 45/20* (2020.01); *F21W 2131/401* (2013.01); *F21Y 2115/10* (2016.08)

(56) References Cited

U.S. PATENT DOCUMENTS

| | | | | |
|---|---|---|---|---|
| 5,301,096 | A | 4/1994 | Klontz et al. | 363/37 |
| 5,494,793 | A | 2/1996 | Schindele et al. | 435/6 |
| 6,188,179 | B1 | 2/2001 | Boys et al. | 315/244 |
| 6,301,128 | B1 | 10/2001 | Jang et al. | 363/17 |
| 6,459,218 | B2 | 10/2002 | Boys et al. | 315/324 |
| 6,825,620 | B2 | 11/2004 | Kuennen et al. | 315/224 |
| 7,125,146 | B2 | 10/2006 | Willis et al. | 362/267 |
| 7,178,178 | B2 | 2/2007 | Hutchings | 4/496 |
| 7,178,941 | B2 | 2/2007 | Roberge et al. | 362/225 |
| 7,180,248 | B2 | 2/2007 | Kuennen et al. | 315/224 |
| 7,182,484 | B2 | 2/2007 | Buelow, II et al. | 362/294 |
| 7,722,216 | B2 | 5/2010 | Amor et al. | F21V 17/00 |
| 8,030,851 | B2 | 10/2011 | Vernondier et al. | 315/149 |
| RE43,492 | E | 6/2012 | Willis et al. | 362/267 |
| 8,502,464 | B2 | 8/2013 | Lakirovich et al. | 315/276 |
| 9,033,557 | B2 | 5/2015 | Potucek et al. | F21V 21/047 |
| 9,046,247 | B2 | 6/2015 | Potucek et al. | F21V 15/01 |
| 9,100,999 | B2 | 8/2015 | Li | H05B 37/02 |
| 9,299,493 | B2 | 3/2016 | Kuennen et al. | H01F 38/14 |
| 9,464,794 | B2 * | 10/2016 | Masterman | F21V 5/04 |
| 9,502,907 | B2 | 11/2016 | Potucek et al. | H02J 5/005 |
| 9,544,964 | B2 | 1/2017 | Li | H05B 33/0845 |
| 9,590,456 | B2 | 3/2017 | Kuennen et al. | H02J 50/10 |
| 10,329,784 | B1 | 6/2019 | Corwin | G05B 15/02 |
| 10,381,872 | B2 | 8/2019 | Potucek et al. | |
| 10,533,770 | B1 * | 1/2020 | O'Keeffe | G01M 3/2876 |
| 10,681,793 | B1 * | 6/2020 | Sanson | F21V 31/00 |
| 10,938,245 | B1 * | 3/2021 | Sanson | F21V 23/06 |
| 11,296,551 | B2 * | 4/2022 | Sanson | H02J 7/0042 |
| 2002/0130627 | A1 | 9/2002 | Morgan et al. | 315/291 |
| 2004/0184284 | A1 | 9/2004 | Buelow, II et al. | 362/547 |
| 2006/0022214 | A1 | 2/2006 | Morgan et al. | 257/99 |
| 2006/0101567 | A1 | 5/2006 | Hutchings | E04H 4/00 |
| 2011/0031740 | A1 | 2/2011 | Stone | 285/139.2 |
| 2011/0267834 | A1 | 11/2011 | Potucek et al. | 362/551 |
| 2013/0098712 | A1 | 4/2013 | Svendsen et al. | 187/381 |
| 2013/0134891 | A1 | 5/2013 | Woytowitz | H05B 37/02 |
| 2013/0182442 | A1 | 7/2013 | Potucek et al. | 362/294 |
| 2013/0249479 | A1 | 9/2013 | Partovi | H02J 7/00 |
| 2014/0092606 | A1 | 4/2014 | Potucek et al. | 362/365 |
| 2014/0203710 | A1 | 7/2014 | Li | 315/129 |
| 2014/0268824 | A1 | 9/2014 | Potucek et al. | 362/366 |
| 2014/0336821 | A1 | 11/2014 | Blaine et al. | 700/275 |
| 2015/0005024 | A1 | 1/2015 | Fudickar et al. | H04W 72/04 |
| 2015/0042223 | A1 | 2/2015 | Harrington | 315/70 |
| 2015/0260375 | A1 | 9/2015 | Potucek et al. | F21V 15/01 |
| 2016/0323952 | A1 | 11/2016 | Li | H05B 33/0845 |
| 2017/0073990 | A1 | 3/2017 | Potucek et al. | E04H 4/1654 |
| 2017/0073991 | A1 | 3/2017 | Potucek et al. | E04H 4/1654 |
| 2017/0127403 | A1 | 5/2017 | Sapio et al. | H04W 72/04 |
| 2017/0133882 | A1 | 5/2017 | Kuennen et al. | H02J 50/10 |
| 2017/0167717 | A1 | 6/2017 | Duarte | F21V 31/005 |
| 2017/0212489 | A1 | 7/2017 | Potucek et al. | G05B 19/042 |
| 2017/0292686 | A1 | 10/2017 | Fuller et al. | F21V 21/15 |
| 2018/0138745 | A1 | 5/2018 | Maud | H02J 50/10 |
| 2019/0174599 | A1 | 6/2019 | Senas | H05B 33/08 |
| 2019/0320515 | A1 * | 10/2019 | Sadwick | H05B 45/00 |
| 2019/0334368 | A1 | 10/2019 | Wambugu Ngahu | H02J 7/02 |
| 2021/0215309 | A1 * | 7/2021 | Tsao | F21S 8/02 |

FOREIGN PATENT DOCUMENTS

| | | | |
|---|---|---|---|
| CN | 108668405 | 10/2018 | H05B 33/08 |
| CN | 109743816 | 5/2019 | H05B 33/08 |
| FR | 2 998 104 | 5/2016 | H01R 43/26 |
| WO | WO 02/101702 | 12/2002 | G09G 3/22 |
| WO | WO 2016/176653 | 11/2016 | H01F 38/14 |
| WO | WO 2017/086520 | 5/2017 | G08C 23/04 |

OTHER PUBLICATIONS

"Colin" catalog, 2016, ShangHai Colin Semiconductor Lighting Co., Ltd, 35 pgs.
Examination Report issued in Australian Application No. 2020205322 dated Sep. 8, 2020, 7 pgs.
"LoRa" Wikipedia page, https://en.wikipedia.org/w/index.php?title=LoRa&oldid=905603424 last edited Jul. 10, 2019, 5 pgs.
"MOD LITE Power Pass Wireless" S.R.Smith, LLC, 2019, 1 pg.
Office Action issued in U.S. Appl. No. 16/543,092, dated Dec. 4, 2019 (17 pgs).
Office Action issued in Canadian Application No. 3,086,364 dated Sep. 2, 2020, 3 pgs.
Office Action issued in U.S. Appl. No. 16/502,748 dated Apr. 16, 2020, 27 pgs.
Notice of Allowance issued in U.S. Appl. No. 16/543,092 dated Mar. 23, 2020, 8 pgs.
YouTube video published Sep. 21, 2009, https://www.youtube.com/watch?v=2IAHkm4RFd4, 2 pgs.
Notice of Allowance issued in U.S. Appl. No. 16/502,748, dated Nov. 12, 2020, 14 pgs.
Examination Report issued in Australian application No. 2020205322, dated Nov. 30, 2020, 6 pgs.
Extended EP Search Report issued in EP Application No. 20185529.3 dated Dec. 17, 2020, 9 pgs.
Notice of Allowance issued in Canadian Application No. 3,086,364 dated Jan. 11, 2021, 1 pg.
Office Action issued in U.S. Appl. No. 16/952,936 dated Jan. 6, 2022, 23 pgs.
Notice of Allowance issued in U.S. Appl. No. 16/952,936 dated Feb. 15, 2022, 11 pgs.
U.S. Appl. No. 16/502,748, filed Jul. 3, 2019, Sanson et al.
U.S. Appl. No. 16/592,936, filed Nov. 19, 2020, Sanson et al.
U.S. Appl. No. 16/543,092, filed Aug. 16, 2019.
U.S. Appl. No. 16/952,936, filed Nov. 19, 2020, Sanson et al.
U.S. Appl. No. 17/562,343, filed Dec. 27, 2021, Sanson.
U.S. Appl. No. 29/825,645, filed Feb. 3, 2022, Sanson.

* cited by examiner

DIRECT WIRELESS CONTROL OF LIGHTING SYSTEMS FOR USE IN A HIGH-MOISTURE ENVIRONMENT

CROSS REFERENCE TO RELATED APPLICATIONS

This application is a continuation of EP Patent Application No. 20185529.3 filed Jul. 13, 2020, which claims priority to U.S. patent application Ser. No. 16/543,092 filed Aug. 16, 2019, now U.S. Pat. No. 10,681,793, the contents of which are incorporated herein in their entirety, by reference.

FIELD OF THE DISCLOSURE

The present disclosure is generally related to lighting systems and more particularly is related to direct wireless control of lighting systems for use in a high-moisture environment.

BACKGROUND OF THE DISCLOSURE

Aquatic lights are commonly used in swimming pools, spas, and other underwater or high-moisture environments, such as showers, saunas, bathtubs, and splash pads. Generally speaking, these conventional aquatic lights can be summarized as one of two types: (1) an older style lighting system, typically an incandescent bulb contained in a watertight housing, which provides simplistic on/off control of a white light; or (2) a more modern lighting system, typically a light-emitting diode (LED) lighting unit with a computerized control unit which allows users to dynamically change a lighting effect of the light, e.g., different colors or patterns, in addition to on/off control.

In further detail, FIG. 1 is a diagrammatical illustration of a conventional lighting system, in accordance with the prior art. In particular, FIG. 1 illustrates the older style lighting system 10A which is typically found in many older swimming pools. The conventional lighting system 10A includes a light housing 12 which is formed in a sidewall 14 of a pool 16 or other structure which contains a quantity of water 18. Typically, the sidewall 14 of the pool 16 is formed from shotcrete, Gunite, or a similar cementitious material such that the housing 12 is embedded in the hardened, concrete wall of the pool 16. The housing 12 contains a light-emitting device 20, such as an incandescent light bulb or other light bulb, which is separated from the water 18 with a cover 22. The light-emitting device 20 receives power from a power supply 24 connected to the light-emitting device 20 with a wired cable 26, which is also typically embedded in at least a portion of the sidewall 14 of the pool 16. The wired cable 26 is usually formed from two or three wires—a positive conductor, a neutral conductor, and optionally, a ground. A switch 28 is used to turn the light on or off, as desired by the user.

As compared to FIG. 1, FIG. 2 is a diagrammatical illustration of a more modern conventional lighting system, in accordance with the prior art. The conventional lighting system 10B includes a light housing 12 which is formed in a sidewall 14 of a pool 16 or other structure which contains a quantity of water 18. Typically, the sidewall 14 of the pool 16 is formed from shotcrete, Gunite®, or a similar cementitious material such that the housing 12 is embedded in the hardened, concrete wall of the pool 16. The housing 12 contains a light-emitting device 20, usually a plurality of multi-colored light-emitting diodes (LEDs) with appropriate circuitry, which are separated from the water 18 with a cover 22. The light-emitting device 20 receives power from a power supply 24 connected to the light-emitting device 20 with a wired cable 26, often run through one or more junction boxes 30, and the wired cable 26 is typically embedded in at least a portion of the sidewall 14 of the pool 16. The wired cable 26 is usually formed from two or three wires—a positive conductor, a neutral conductor, and optionally, a ground.

Additionally, the conventional lighting system 10B includes a control unit 40 which is used to control the lighting effect or characteristic of the light-emitting device 20. The control unit 40 may be connected to the light-emitting device 20 with one or more control low voltage cables 42 which, similar to the wired cable 26 of the power source, are embedded in the concrete sidewall 14. In some cases, the control cables 42 can be the same cables as the wired cables 26 for the power source 24, since a switch mode or powerline control can be used to control the lighting effect or characteristic of the light-emitting device 20. When the control cables 42 are separate from the wired cables 26, they may typically include a 6-core wire.

The control unit 40 may be a computerized device which includes programmable code and software along with a user interface to convert human instructions into the desired lighting effect. Often times the control unit 40 has an external user interface 44 which is electronically connected to the control unit 40, where the external user interface 44 has an interactive display interface 46 which the user interacts with to control the pool lighting, as well as other features of the pool, such as the pump speed, water features, etc. These devices—the control unit 40 and the external user interface 44—are often located with or very near the pool pump and filter, which are usually located many feet or meters away from the pool 16 itself to ensure the noise and aesthetics of the pool pump and filter do not negatively affect the user's experience in the pool. As a result, most users prefer to engage with the control unit through a wireless connection 48, such as WIFI®, using a mobile device, such as a smart phone, or a computer. Both lighting systems 10A, 10B have deficiencies. With the older lighting system 10A, the single light bulb doesn't allow users to change anything other than an on/off state, which is technologically outdated. The single light bulb can require changing often, which is a time-consuming and inefficient process, sometimes involving draining or partial draining of the swimming pool 16. Individuals with pools having the older lighting system 10A routinely want to replace them with the more modern lighting system 10B but they often can't do so because of the spatial limitations of the older lights and the lack of appropriate wiring and cables for controlling the new lighting unit. Moreover, running new cables to the light housing 12 involves a partial digging of the pool 16 sidewall 14, which is difficult and often impractical.

With the newer lighting system 10B, users have more control over their pool lights but these systems are expensive and cumbersome to install and use. For one, additional wiring is often needed, along with a dedicated control unit 40, and an external user interface 44, which can easily add $1,500 or more to the price of a pool. When this equipment is located outside of a backyard fence, as is common, using the external user interface 44 to alter, adjust, or control the pool features can be frustrating since it requires the user to be physically present at the external user interface 44. Importantly, this situation can often be unsafe too. For example, in certain hot climates where swimming pools are popular, such Australia and the American Southwest, pools are often built within secure fences to prevent animals, reptiles, and insects from accessing the pool. These animals may include venomous snakes, such as the Rattlesnake present in the American Southwest. After a user finishes swimming, he or she would need to go outside of this secure fence to shut off the pool lights, which subjects the user to undesirable and unsafe conditions of stepping on a snake or other creature. Control provided through a wireless connection can improve the situation, but the control unit 40 or external user interface 44 itself must have an Internet or network connection to function. This can be difficult to ensure when the pool equipment is located more than 20-30 feet from a residence. In this situation, the user may be left with no choice but to incur the costs of setting up a secondary Internet connection for the control unit 40, or be subjected to the dangers of physically walking to the external user interface 44.

Thus, a heretofore unaddressed need exists in the industry to address the aforementioned deficiencies and inadequacies.

SUMMARY OF THE DISCLOSURE

Embodiments of the present disclosure provide a lighting system for use in a high-moisture environment. Briefly described, in architecture, one embodiment of the system, among others, can be implemented as follows. A lighting unit is positioned in a high-moisture environment. The lighting unit has a housing and at least one light-emitting device positioned within the housing. A power supply provides power to the at least one light-emitting device. A receiver is positioned within the housing. The receiver operates with a Long Range (LoRa) modulation format and is configured to receive signals. A mobile control unit is located remote from the lighting unit. The mobile control unit is configured to transmit at least one wireless control signal to the receiver, whereby the at least one control signal controls or changes a characteristic of the at least one light-emitting device.

The present disclosure can also be viewed as providing a lighting system for use in a swimming pool holding a quantity of water. Briefly described, in architecture, one embodiment of the system, among others, can be implemented as follows. A lighting unit has a housing and at least one light-emitting device positioned within the housing. The housing is embedded within a concrete wall of the swimming pool. A wired power supply provides power to the at least one light-emitting device, wherein the wired power supply extends at least partially through the concrete wall of the swimming pool. A receiver is positioned within the housing. The receiver operates with a Long Range (LoRa) modulation format and is configured to receive signals. A mobile control unit is located remote from the lighting unit. The mobile control unit transmits at least one wireless control signal to the receiver to change a characteristic of the at least one light-emitting device. The characteristic of the at least one light-emitting device further comprises at least one of: an on/off state, a color, a pulse timing, or a pattern of display.

The present disclosure can also be viewed as providing methods of installing a lighting system for use in a high-moisture environment. In this regard, one embodiment of such a method, among others, can be broadly summarized by the following steps: positioning a lighting unit in a high-moisture environment, the lighting unit having a housing, at least one light-emitting device positioned within the housing, and a receiver is positioned within the housing, whereby the receiver is configured to operate with a Long Range (LoRa) modulation format and configured to receive signals; providing a power supply to power the at least one light-emitting device; and using a mobile control unit located remote from the lighting unit, transmitting at least one wireless control signal to the receiver to control or change a characteristic of the at least one light-emitting device.

Other systems, methods, features, and advantages of the present disclosure will be or become apparent to one with skill in the art upon examination of the following drawings and detailed description. It is intended that all such additional systems, methods, features, and advantages be included within this description, be within the scope of the present disclosure, and be protected by the accompanying claims.

BRIEF DESCRIPTION OF THE DRAWINGS

Many aspects of the disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views.

DETAILED DESCRIPTION

Figure 3:
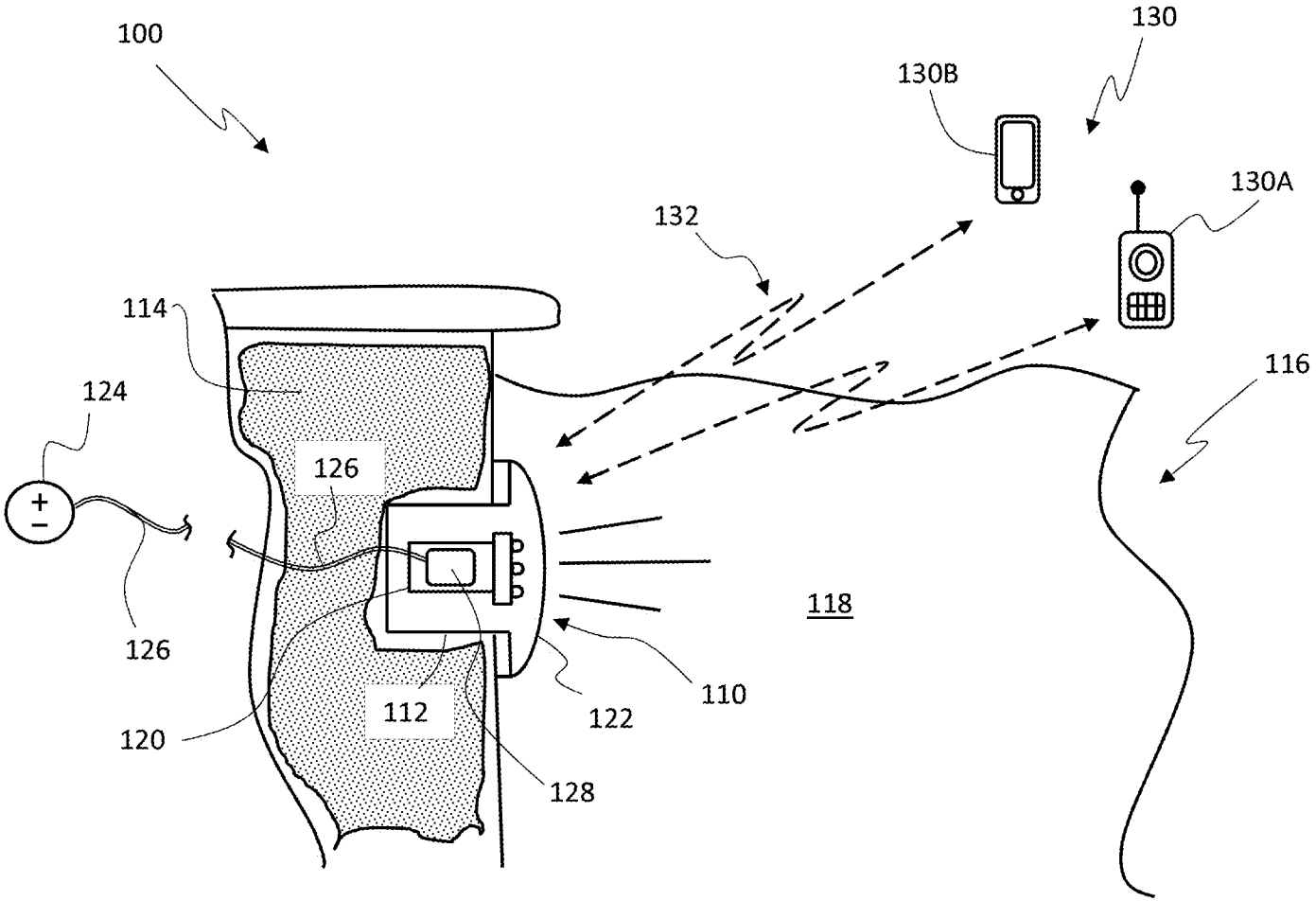
FIG. 3 is a diagrammatical illustration of a lighting system for use in a high-moisture environment, in accordance with a first exemplary embodiment of the present disclosure.

FIG. 3 is a diagrammatical illustration of a lighting system for use in a high-moisture environment 100, in accordance with a first exemplary embodiment of the present disclosure. The lighting system for use in a high-moisture environment 100, which may be referred to herein simply as 'lighting system 100' or 'system 100' may be used. The lighting system 100 includes a lighting unit 110 positioned in a high-moisture environment, such as a swimming pool, a spa, a sauna, or other recreational or health-related aquatic structure, as well as other aquatic structures such as showers, bathtubs, steam showers, etc. For clarity, the subject disclosure is discussed relative to a swimming pool as the high-moisture environment, but the invention may be used with any other high-moisture environment without limitation.

The lighting unit 110 has a housing 112 which may be a rigid or semi-rigid enclosure which is embedded within a sidewall 114 of the pool 116 which holds a quantity of water 118. The sidewall 114 may be formed from a concrete material in which the housing 112 is placed prior to curing of the concrete, such that the housing 112 is stationarily retained within the sidewall 114 on a face thereof that abuts the water 118. The housing 112 contains or encloses at least one light-emitting device, generally denoted at 120, which includes various components for producing light within the water 118. For example, the light-emitting device 120 may include a frame or structure which houses circuitry and light-emitting diodes (LEDs) which, when powered, supply light into the water 118. In one example, the light-emitting device 120 may be an LED lamp having at least four colors, including white, red, green, and blue. The light-emitting device 120 may be separated from the water 118 with a housing cover 122, which is commonly a transparent or partially transparent structure, which creates a barrier between the light-emitting device 120 and the water. The cover 122 may be water-tight or non-water-tight. The light-emitting device 120 receives electrical power, such as a 12V DC supply, from a power supply 124 which is in electrical communication with the light-emitting device 120 through at least one power cable 126. The power cable 126 may be a conventional two or three conductor wire, e.g., having a positive conductor, a neutral conductor, and a ground wire, which is positioned at least partially through the sidewall 114 of the pool 116.

The light-emitting device 120 further includes at least one receiver 128 which is positioned fully within the housing 112, and more specifically, commonly fully within the unitary structure of the framework or structure of the light-emitting device 120. The receiver 128 may operate with a Long Range ("LoRa") modulation format, such that it is configured to receive signals at a specific operating frequency. Specifically the receiver 128 is configured to use the LoRa spread spectrum modulation technique which provides for a long range, low power wireless circuitry which enables the receiver 128 to receive control signals without the conventional, intermediary control units, such as those placed with pool pumps and filters or accessible through WIFI® connections. Thus, as shown in FIG. 3, with the exception of the wired power supply 126 connection, the housing 112 of the lighting unit 110 is free from any and all other external wired communication or control connections thereto.

In further detail, the LoRa modulation format may include physical circuitry which uses a spread spectrum modulation that may be similar to and a derivative of Chirp Spread Spectrum modulation (CSS). This allows LoRa to trade off data rate for sensitivity with a fixed channel bandwidth by selecting the amount of spread used (a selectable radio parameter from 7 to 12). This spreading factor may determine the data rate and dictates the sensitivity of a radio. In addition, LoRa uses forward error correction coding to improve resilience against interference. Additionally, the LoRa modulation format may further include a networking protocol managing communications between gateways and end-node devices, such as by managing communication frequencies, data rate, and power consumption for connected devices. The LoRa modulation technique used by the receiver 128 allows the receiver 128 to have high sensitivity levels, such that it can receive signals 10 times weaker than most radios. Normally, with an increase in sensitivity, the receiver would also experience an effective increase in power, but the LoRa modulation technique provides the improved range without any increase in power consumption or transmitter power. Thus, it provides a beneficial increase to the communication range of a wireless data link without the traditional negative side effects.

The receiver 128 using the LoRa modulation technique may operate at a predefine frequency or frequencies, or within predefined frequency ranges, which are considered 'low frequency.' The specific frequency, frequencies, or range thereof may be dependent on the geographic setting in which the receiver 128 is used. For the majority of jurisdictions, the frequency range will be a low frequency range of substantially between 433.05-434.79 MHz which may be understood within the industry as the EU433 channel. While this EU433 channel includes a range of between 433.05-434.79 MHz, it is noted that substantially similar frequencies which lie slightly outside this range are considered within the EU433 channel. The exact frequency of operation may be adjusted to be more specific, such as operating at a specific frequency between 433.05-434.79 MHz and/or fluctuations within the range thereof. The following table lists exemplary frequencies and their corresponding country or jurisdiction:

| Country or Jurisdiction | Band/Channel |
|---|---|
| Argentina | 902-928 MHz |
| Austria | 433.05-434.79 MHz |
| Australia | 915-928 MHz |
| Bangladesh | 433.05-434.79 MHz |
| Belgium | 433.05-434.79 MHz |
| Brazil | 433-435 MHz |
| Canada | 902-928 MHz |
| Chile | 902-928 MHz |
| China | 920.5-924.5 MHz |
| | 779-787 MHz |
| | 470-510 MHz |
| | 433.05-434.79 MHz |
| Denmark | 433.05-434.79 MHz |
| France | 433.05-434.79 MHz |
| Germany | 433.05-434.79 MHz |
| Hong Kong | 433.05-434.79 MHz |
| India | 865-867 MHz |
| Israel | 433.05-434.79 MHz |
| Italy | 433.05-434.79 MHz |
| Japan | 920.6-928.0 MHz (steps of 200 kHz) |
| | 920.8-927.8 MHz (steps of 600 kHz) |
| Malaysia | 433-435 MHz |
| Mexico | 902-928 MHz |
| Netherlands | 433.05-434.79 MHz |
| New-Zealand | 915-928 MHz |
| | 819-824 MHz |
| | 864-870 MHz |
| | 433.05-434.79 MHz |
| Singapore | 920-925 MHz |
| | 433.05-434.79 MHz |
| | 866-869 MHz |
| South Korea | 917-923.5 MHz |
| Spain | 433.05-434.79 MHz |
| Thailand | 433.05-434.79 MHz |
| | 920-925 MHz |

-continued

| Country or Jurisdiction | Band/Channel |
|---|---|
| United Arab Emirates | 433.05-434.79 MHz |
| | 863-870 MHz |
| | 870-875.8 MHz |
| | 915-921 MHz |
| United Kingdom | 433.05-434.79 MHz |
| | 863-873 MHz |
| | 918-921 MHz |
| United States | 433.05-434.79 MHz |
| | 902-928 MHz |

Other jurisdictions and geographical locations may have other frequencies or frequency ranges, all of which are considered within the scope of the present disclosure. For clarity in disclosure, the receiver 128 is described relative to the EU433 channel plan, where the receiver 128 is capable of receiving signals at a frequency of substantially between 433.05-434.79 MHz, however other frequencies may be used when implemented in other jurisdictions.

The system 100 further includes at least one mobile control unit 130 located remote from the lighting unit 110 which is capable of controlling or changing a characteristic or operation of the light-emitting device 120. The mobile control unit 130 may include a remote controller 130A, a mobile smartphone 130B, or any other similar computerized or electronic device. The mobile control unit 130 may include a graphical user interface, such as a touch screen with visual display, a plurality of selectable buttons, a color-selection device, and/or a number of other features. The mobile control unit 130 is configured to transmit at least one wireless control signal 132 to the receiver 128 at a frequency between 433.05-434.79 MHz (EU433). The wireless control signal 132 includes data indicative of a characteristic, effect, quality, or operation of the light-emitting device 120, such that receipt of the wireless control signal 132 by the receiver 128 instructs a change in the light-emitting device 120. Thus, by receiving the wireless control signal 132 at the receiver 128, the wireless control signal 132 controls or changes the characteristic, effect, quality, or operation of the at least one light-emitting device 120.

Use of mobile control unit 130 to send the wireless control signal 132 to change or control characteristic, effect, quality, or operation of the light-emitting device 120 may allow the human user to easily and efficiently control the lights in his or her swimming pool. For example, the user can turn the light-emitting device 120 on or off, change a color of the light display, change a pattern or effect of change between light colors and timing (pulse timing), or control or change any other operation of the light-emitting device 120. Importantly, the user can change or control the light-emitting device 120 directly from his or her smartphone 130B or remote controller 130A without the need of an intermediary control unit. Rather, the wireless control signal 132 is transmitted directly from the mobile control unit 130 held by the user, at least partially through the water 118 of the pool 116, and to the receiver 128 positioned within the housing 112 of the lighting unit 110. This allows the user to be located in any location around the pool 116 and still retain the ability to control the lighting unit 110. In comparison to the conventional systems, as discussed in the Background, one of the many benefits of the present disclosure is that it does not require a separate control unit positioned near the pool pump or filter, nor does it require a GUI for that separate control unit, nor does it require a WIFI® connection to communicate with the separate control unit or GUI of the control unit. By eliminating these devices, the user can enjoy more simplistic control of pool lights without the added expense and complicated operations of these components or the hazards that may accompany them.

Figure 1:
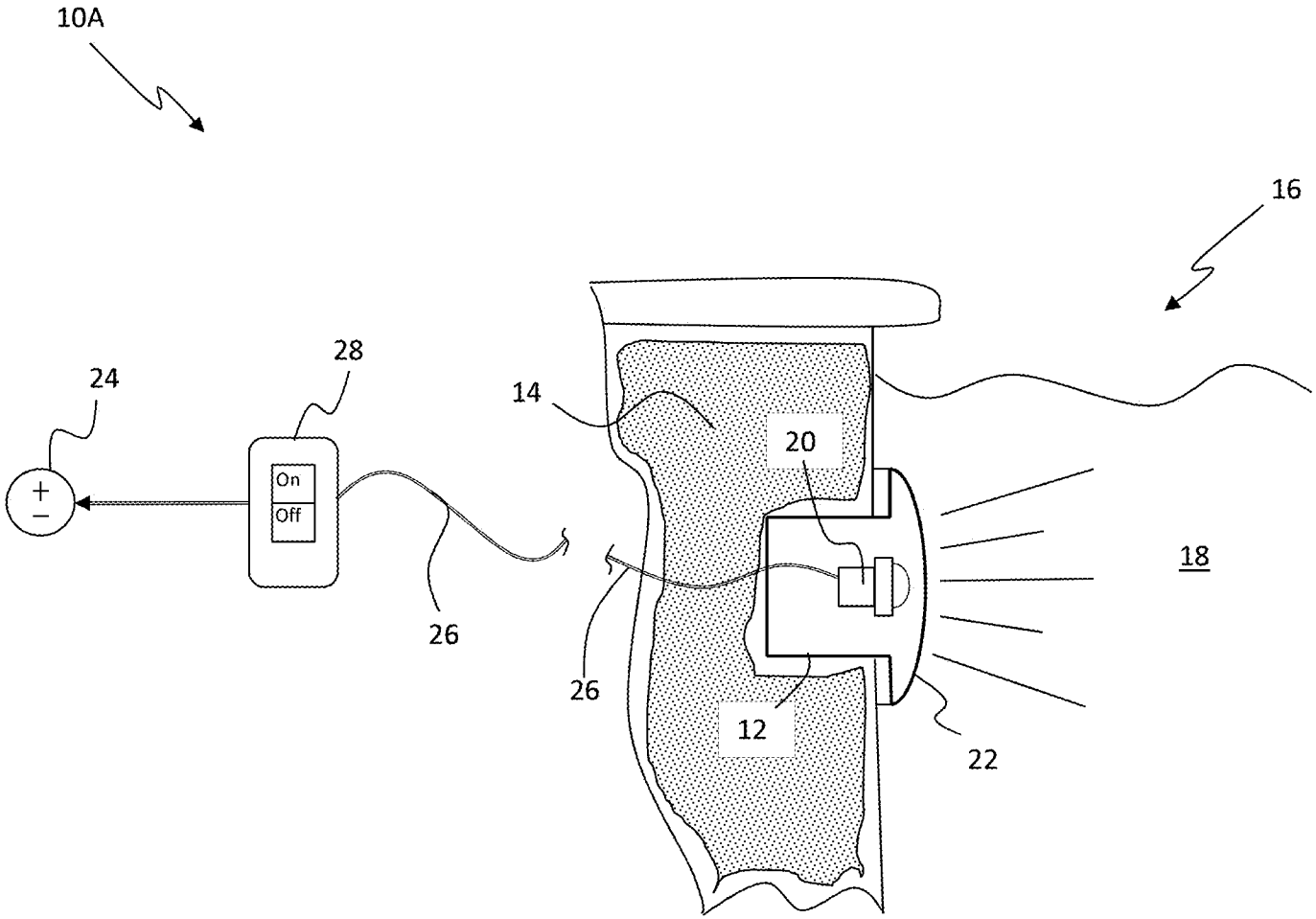
FIG. 1 PRIOR ART
FIG. 1 is a diagrammatical illustration of a conventional lighting system, in accordance with the prior art.
Figure 2:
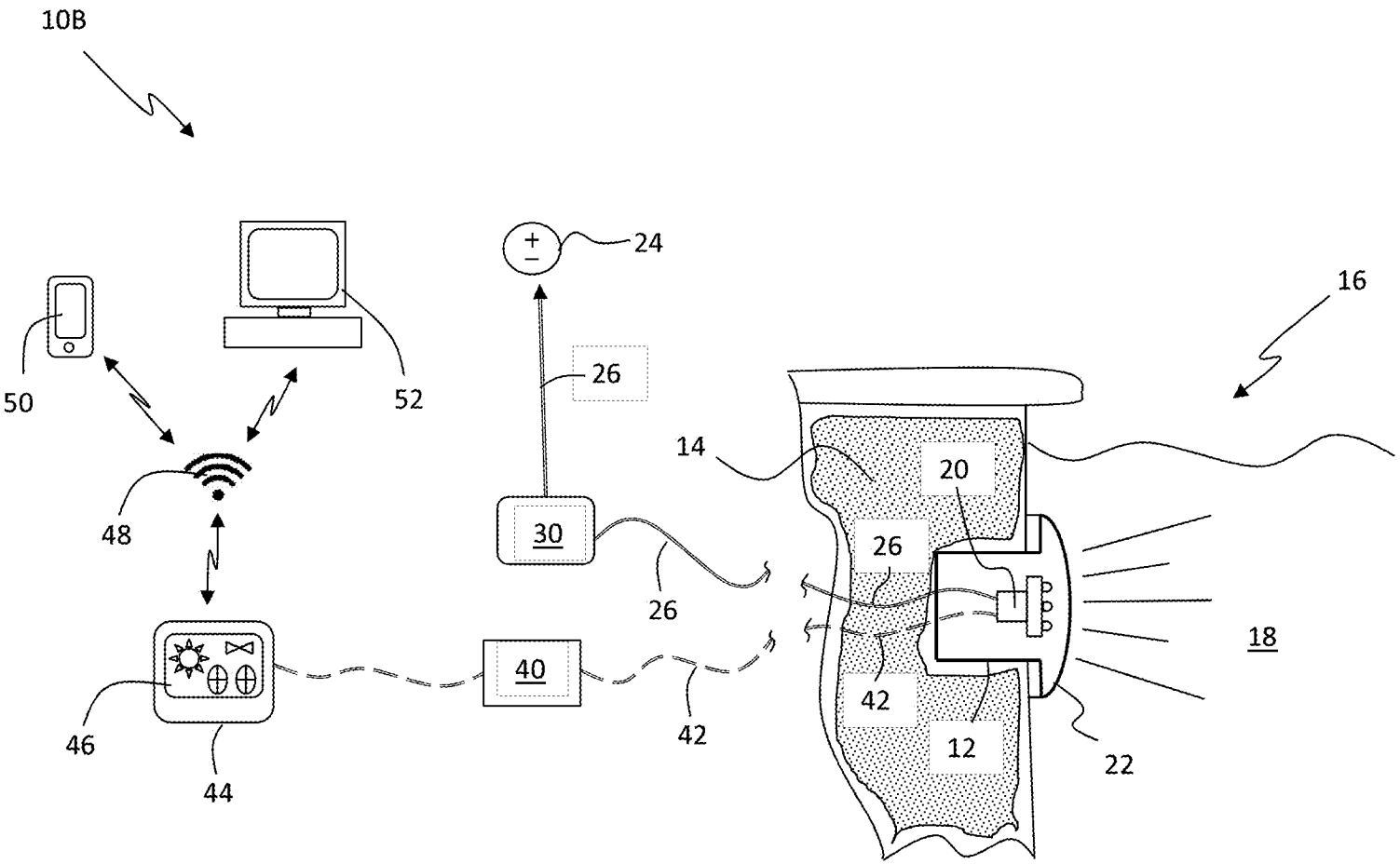
FIG. 2 PRIOR ART
FIG. 2 is a diagrammatical illustration of a modern conventional lighting system, in accordance with the prior art.

In addition, the subject disclosure also allows individuals who own pools with an older style light, such as that discussed relative to FIG. 1, to retrofit or change their pool lighting system easily. These older style lights typically only have power supply cables connected to them, often through a concrete sidewall of the pool, making it impractical and inefficient to run new control wiring to the light housing. However, these older lights can be removed and new lights in accordance with teachings of this disclosure can be installed in the existing light housings. The new lights are connected to the existing power supply and the cover is installed to enclose the lighting unit 110 in the housing. Once powered up, the new lights can be controlled by the user's smartphone 130B or other controller, transmitting a direct signal to the receiver 128 in the lighting unit 110. This ability to retrofit older pools with modern lighting without needing to undergo concrete removal or other expensive construction provides numerous benefits to pool owners and pool servicers alike.

Figure 4A:
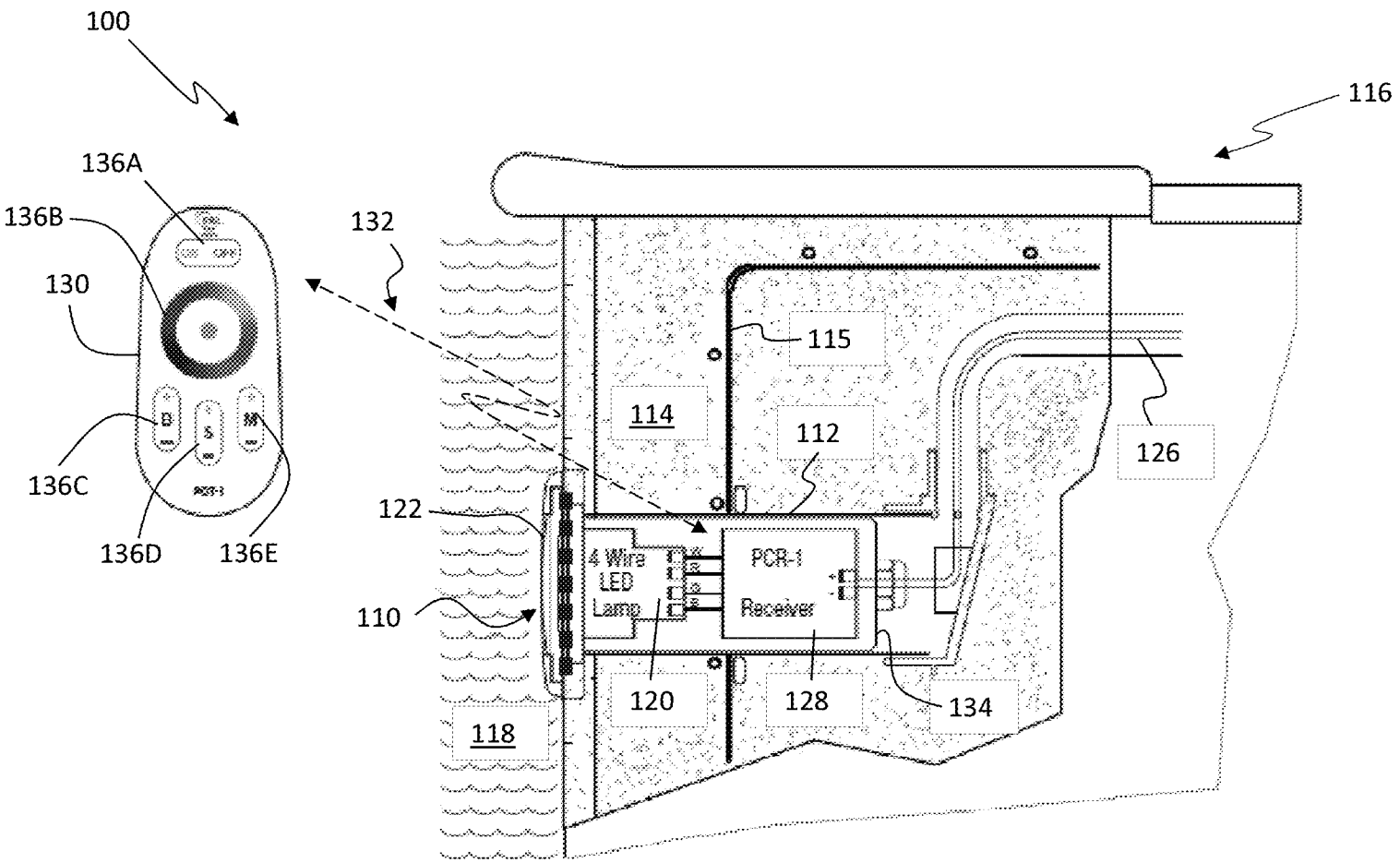
FIG. 4A is a diagrammatical illustration of the lighting system for use in a high-moisture environment of FIG. 3 in additional detail showing a four wire light, in accordance with the first exemplary embodiment of the present disclosure.

FIG. 4A is a diagrammatical illustration of the lighting system 100 for use in a high-moisture environment of FIG. 3 in additional detail, in accordance with the first exemplary embodiment of the present disclosure. In particular, FIG. 4A illustrates a four wire lighting unit 110 positioned within a pool 116 sidewall 114 and a mobile control unit 130 sending a wireless control signal 132 to the receiver 128. The housing 112 is embedded within the concrete sidewall 114 of the pool 116 in a position below the decking and/or coping of the pool 116. The housing 112 may be installed proximate to steel rod 115 (rebar) used to structurally reinforce the pool sidewall 114. Typically, the housing is located approx. 1.0 ft. (300 mm) below the surface of the water 118 or approx. 1.5 ft. (450 mm) below the coping surface. A forward portion of the housing 112 is positioned proximate to the finish surface of the pool 116, such as a plaster, tile, or pebble-based surface, such that the cover 122 can be positioned in abutment with the finished surface.

The lighting unit 110 includes a light-emitting device 120 which is a 4 wire LED lamp having the colors: white, red, green, and blue. This LED lamp is connected to the receiver 128 which is a PCR-1 receiver, which is connected to the wired power supply 126. As shown, with the exception of the wired power supply 126 connection, the housing 112 of the lighting unit 110 is free from any and all other external wired communication or control connections thereto. The operation of the system 100 as disclosed in FIG. 4A is the same as discussed relative to FIG. 3, where the user uses the mobile control unit 130 to send a control signal 132 to the receiver 128 to control or change the light. As shown in FIG. 4A, the mobile control unit 130 may include various selectable buttons or interfaces, including an on/off switch 136A, a color wheel 136B which allows for selection of a color, and buttons for adjusting a brightness of the lights 136C, a speed of a lighting pattern change or lighting effect 136D, and a mode selection for the pattern or lighting effect 136E.

It is noted that the housing 112 may be a pool niche or similar wall fitting which receives the lighting unit 110 therein and has a partition 134 to separate a wet environment from a dry environment. For example, as shown in FIG. 4A, the lighting unit 110 including the light-emitting device 120 and the receiver 128 may be positioned on a wet side of the partition 134, whereas the power supply cable 126 is positioned through the partition 134 to a dry side. This partition 134 allows the cover 122 to be non-water tight, such that water 118 from the pool can fill the interior of the housing 112 and surround the light-emitting device 120 and the receiver 128, but be kept from leaking out of the rear of the housing 112 by the partition 134.

Figure 4B:
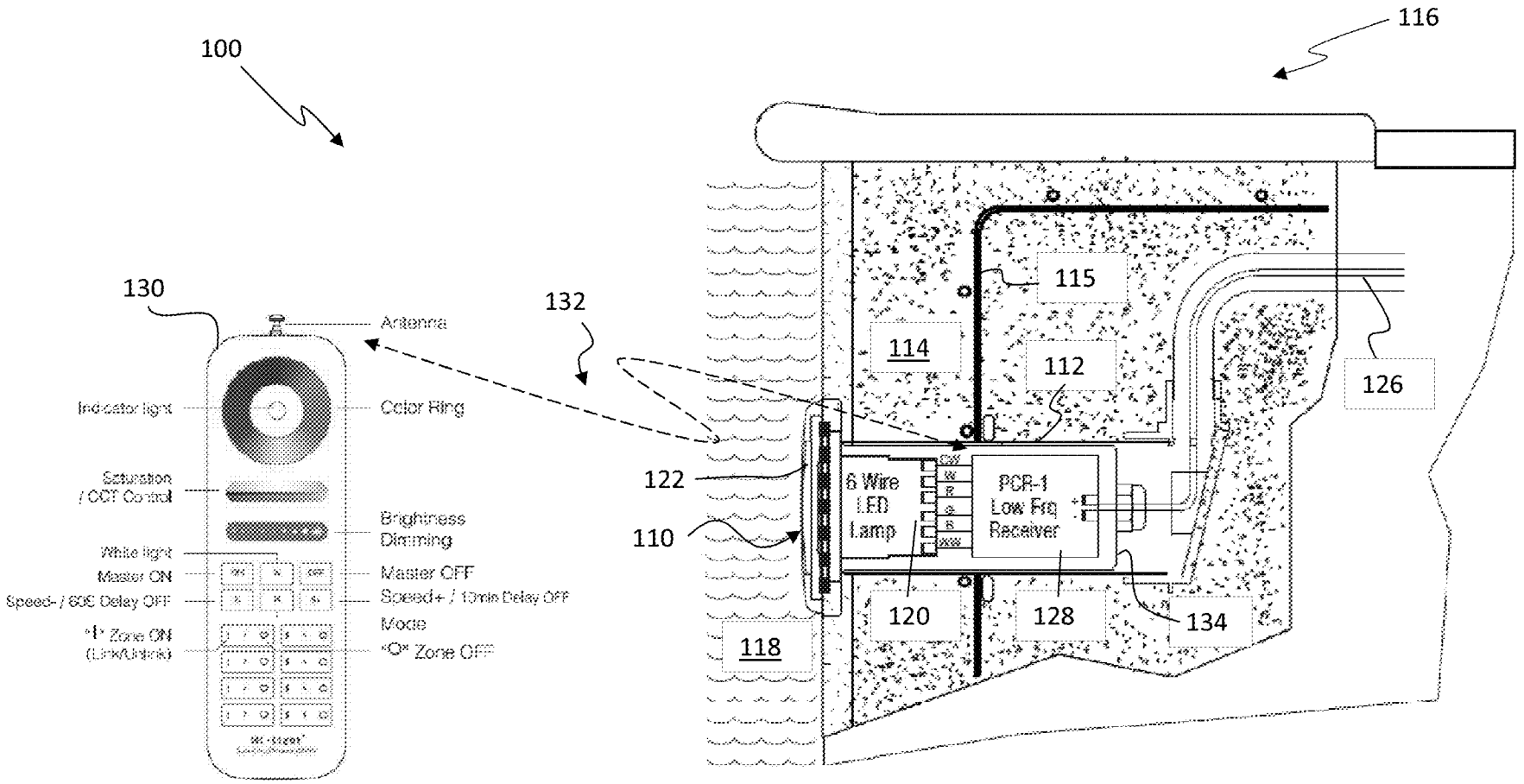
FIG. 4B is a diagrammatical illustration of the lighting system for use in a high-moisture environment of FIG. 3 in additional detail showing a six wire light, in accordance with the first exemplary embodiment of the present disclosure.

FIG. 4B is a diagrammatical illustration of the lighting system 100 for use in a high-moisture environment of FIG. 3 in additional detail, in accordance with the first exemplary embodiment of the present disclosure. In particular, FIG. 4B illustrates a six wire lighting unit 110 positioned within a pool 116 sidewall 114 and a mobile control unit 130 sending a wireless control signal 132 to the receiver 128. The housing 112 is embedded within the concrete sidewall 114 of the pool 116 in a position below the decking and/or coping of the pool 116. The housing 112 may be installed proximate to steel rod 115 (rebar) used to structurally reinforce the pool sidewall 114. Typically, the housing is located approx. 1.0 ft. (300 mm) below the surface of the water 118 or approx. 1.5 ft. (450 mm) below the coping surface. A forward portion of the housing 112 is positioned proximate to the finish surface of the pool 116, such as a plaster, tile, or pebble-based surface, such that the cover 122 can be positioned in abutment with the finished surface. The lighting unit 110 includes a light-emitting device 120 which is a six wire LED lamp having the standard colors of white, red, green, and blue, as well as cool white and warm white. The six wire LED lamp allows the end user the ability to control the kelvins of the LED lamp to produce cool white or warm white colors, as well as the ability to control the LED lamp's red, green, and blue colors. This LED lamp is connected to the receiver 128 which is a PCR-1 receiver, which is connected to the wired power supply 126. As shown, with the exception of the wired power supply 126 connection, the housing 112 of the lighting unit 110 is free from any and all other external wired communication or control connections thereto. The operation of the system 100 as disclosed in FIG. 4B is the same as discussed relative to FIG. 3, where the user uses the mobile control unit 130 to send a control signal 132 to the receiver 128 to control or change the light. As shown in FIG. 4B, the mobile control unit 130 may include various selectable buttons or interfaces, including an antenna at the top end of the unit, a color ring which has a variety of different colors positioned along the ring such that the user can select the desired color, an indicator light in the middle of the color ring, a saturation/CCT control feature, a brightness/dimming feature, master ON/OFF controls, a white light control, a speed or delay control with increases and decreases, a mode of operation control, a zone ON/OFF control, as well as other features.

It is noted that the housing 112 may be a pool niche or similar wall fitting which receives the lighting unit 110 therein and has a partition 134 or housing to separate a wet environment from a dry environment. For example, as shown in FIG. 4B, the lighting unit 110 including the light-emitting device 120 and the receiver 128 may be positioned on a wet side of the partition 134 (or within a housing having the partition), whereas the power supply cable 126 is positioned through the partition 134 to a dry side. This partition 134 or housing allows the cover 122 to be non-water tight, such that water 118 from the pool can fill the interior of the housing 112 and surround the light-emitting device 120 and the receiver 128, but be kept from leaking out of the rear of the housing 112 by the partition 134.

Figure 5A:
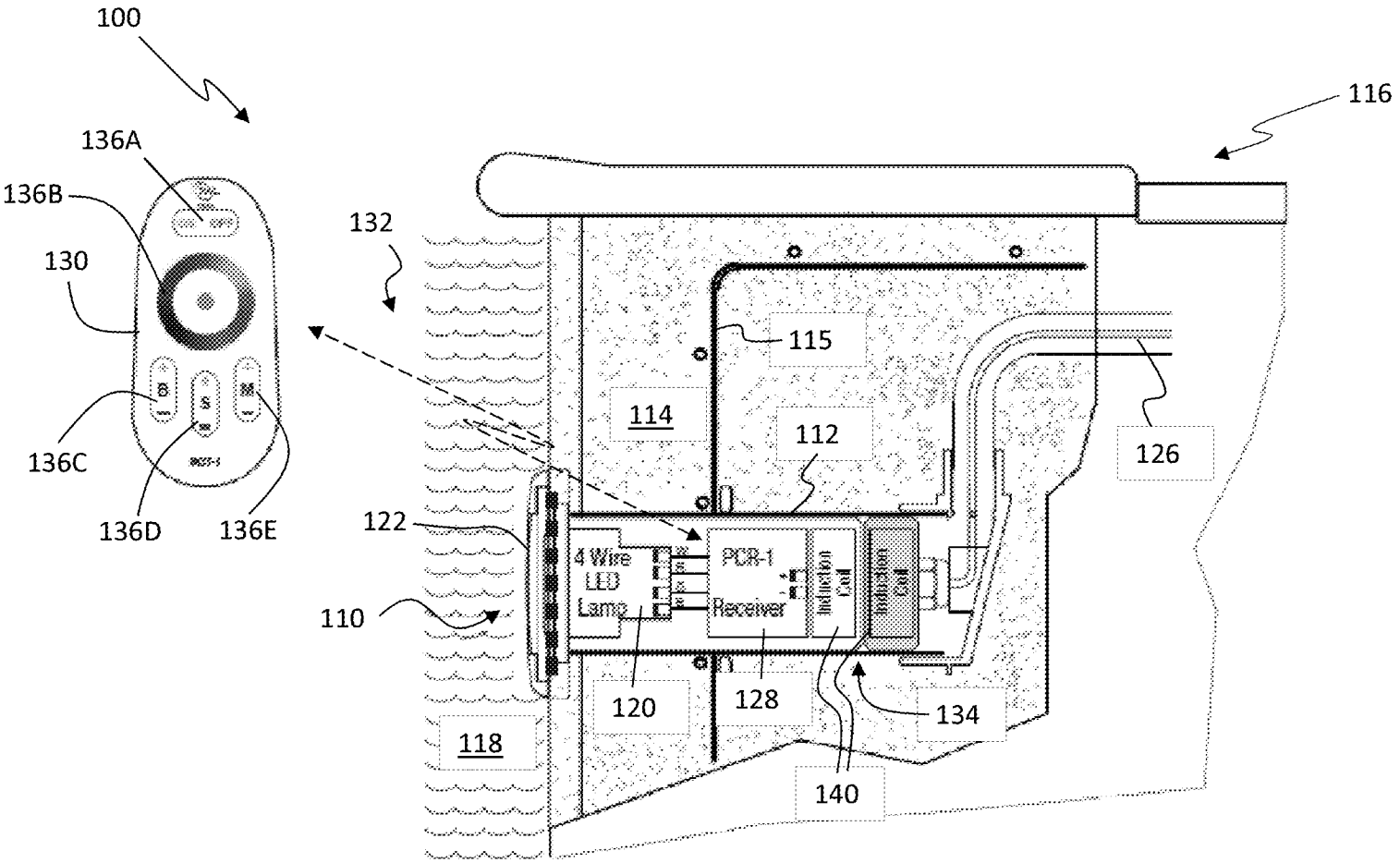
FIG. 5A is a diagrammatical illustration of the lighting system for use in a high-moisture environment of FIG. 3 in additional detail showing a four wire light, in accordance with the first exemplary embodiment of the present disclosure.

FIG. 5A is a diagrammatical illustration of the lighting system 100 for use in a high-moisture environment of FIG. 3 in additional detail, in accordance with the first exemplary embodiment of the present disclosure. FIG. 5A illustrates the same system 100 as illustrated and discussed relative to FIG. 4A, and as such, the same reference characters apply and the same operation as discussed relative to FIGS. 3-4 apply. However, the system 100 of FIG. 5A further includes a light-emitting device 120 powered through induction and using two induction coils 140, an induction transmitter and an induction receiver. Instead of a direct wired power supply 126 connected to the receiver 128, as is shown in FIG. 4A, the induction-based light-emitting device 120 receives the power supply at a first induction coil, i.e., an induction transmitter, located on a dry side of the partition 134. The induction coil 140 then transmits power through induction to the second induction coil, i.e., an induction receiver, located on the wet side of the partition 134. The use of the induction coils 140 allow for the light-emitting device 120 to be more easily removed or replaced, since the electrical contact between the induction coils 140 is free from a wired connection.

Figure 5B:
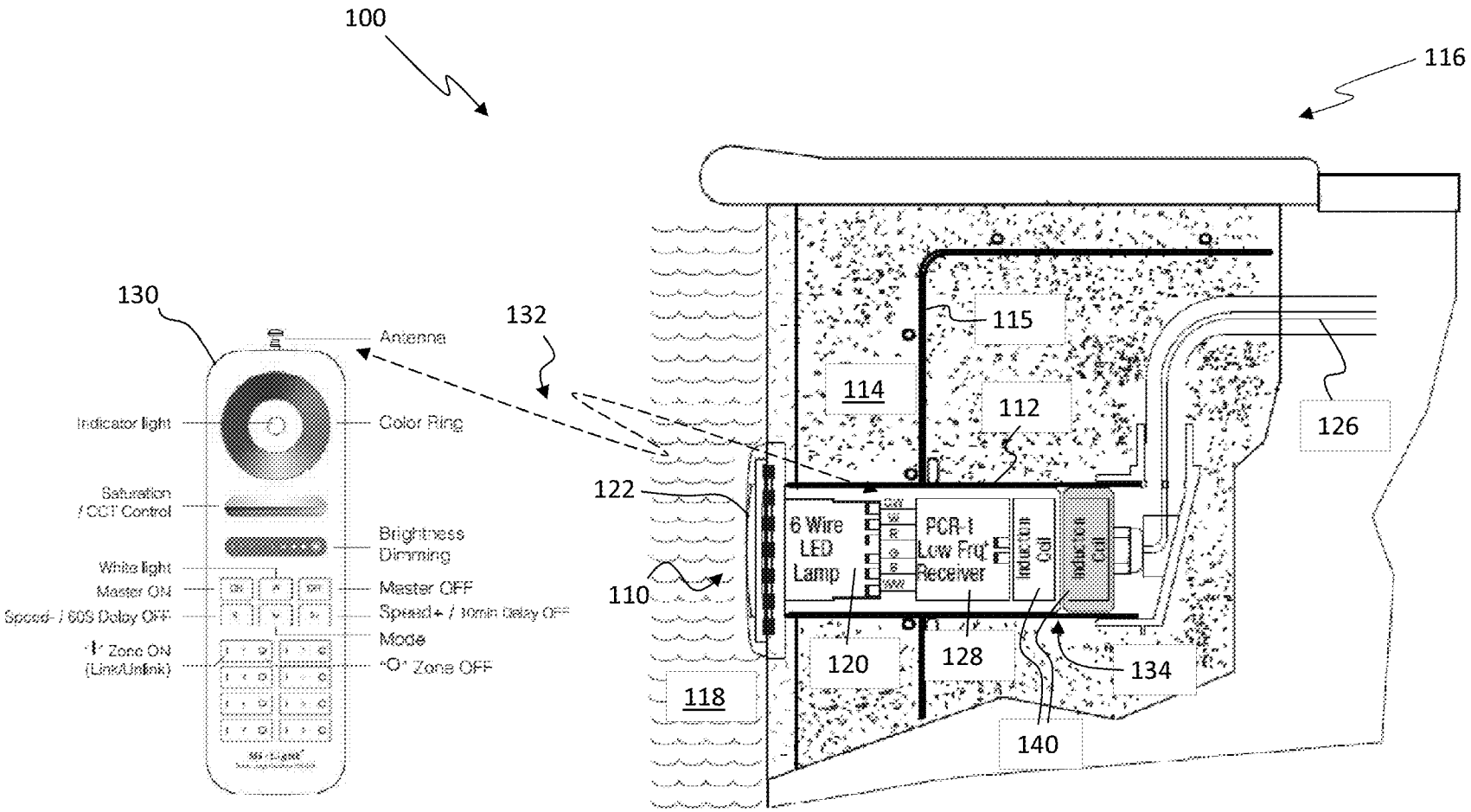
FIG. 5B is a diagrammatical illustration of the lighting system for use in a high-moisture environment of FIG. 3 in additional detail showing a six wire light, in accordance with the first exemplary embodiment of the present disclosure.

FIG. 5B is a diagrammatical illustration of the lighting system 100 for use in a high-moisture environment of FIG. 3 in additional detail, in accordance with the first exemplary embodiment of the present disclosure. FIG. 5B illustrates the same system 100 as illustrated and discussed relative to FIG. 4B, and as such, the same reference characters apply and the same operation as discussed relative to FIGS. 3-4B apply. However, the system 100 of FIG. 5B further includes a light-emitting device 120 powered through induction and using two induction coils 140, an induction transmitter and an induction receiver. Instead of a direct wired power supply 126 connected to the receiver 128, as is shown in FIG. 4B, the induction-based light-emitting device 120 receives the power supply at a first induction coil, i.e., an induction transmitter, located on a dry side of the partition 134. The induction coil 140 then transmits power through induction to the second induction coil, i.e., an induction receiver, located on the wet side of the partition 134. The use of the induction coils 140 allow for the light-emitting device 120 to be more easily removed or replaced, since the electrical contact between the induction coils 140 is free from a wired connection.

Figure 6:
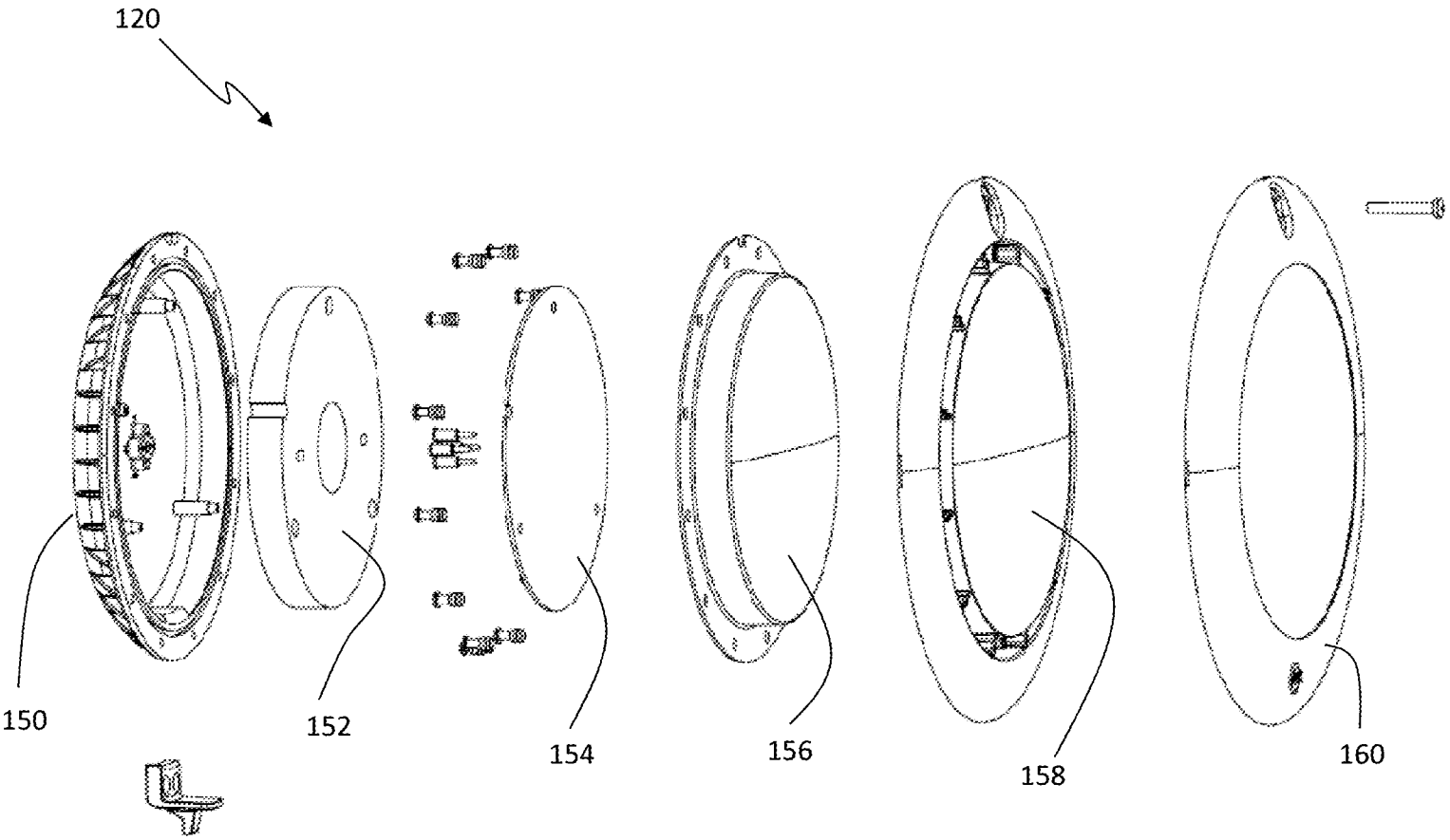
FIG. 6 is an exploded view illustration of components in a lighting unit of the lighting system for use in a high-moisture environment of FIGS. 5A-5B, in accordance with the first exemplary embodiment of the present disclosure.

FIG. 6 is an exploded view illustration of components in a lighting unit 120 of the lighting system 100 for use in a high-moisture environment of FIGS. 5A-5B, in accordance with the first exemplary embodiment of the present disclosure. As shown, FIG. 6 depicts the lighting unit 120 components in exploded view, including a base frame 150 with mounting projections for receiving an induction transmitter coil 152. A mounting plate 154 is positionable between the induction transmitter coil 152 and an induction receiving coil 156, which has a flange for mounting to the mounting plate 154 and base frame 150. An interior cover 158 is positionable over the induction receiving coil 156 and a finish cover 160 is provided for finishing the exterior of the lighting unit 120.

Figure 7A:
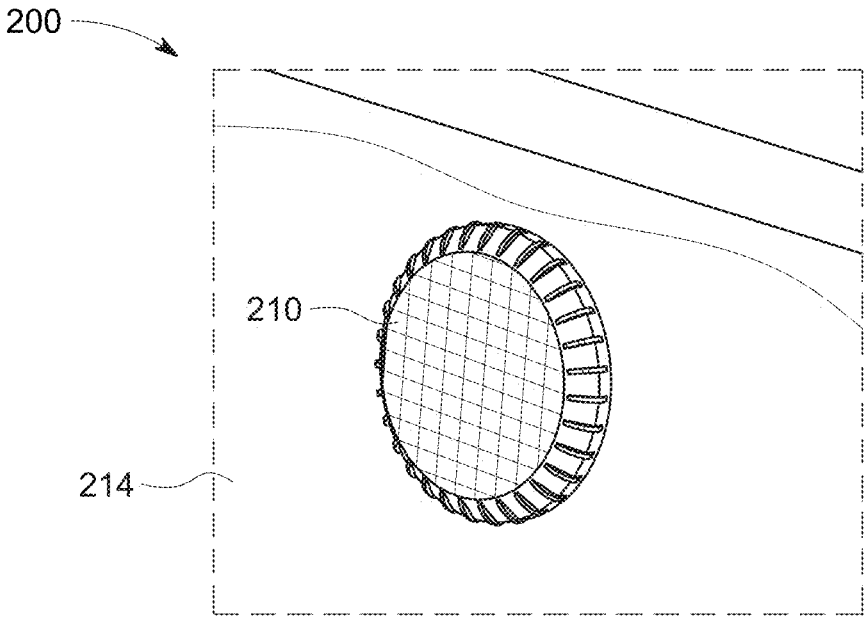
FIGS. 7A-7F are diagrammatical illustrations of a method of installing and using the lighting system for use in a high-moisture environment of FIG. 3, in accordance with the first exemplary embodiment of the present disclosure.
Figure 7B:
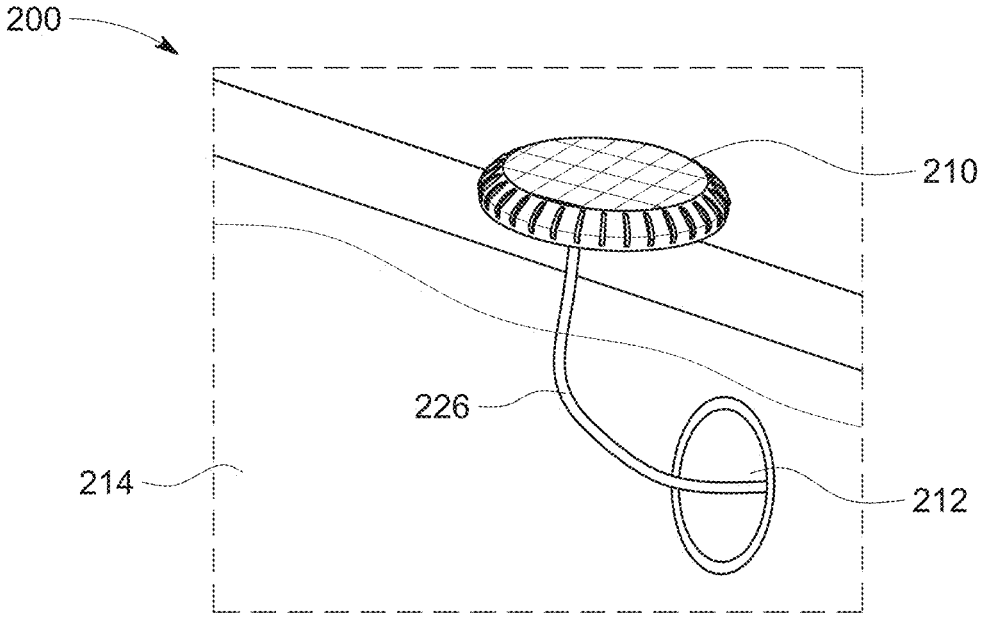
Figure 7C:
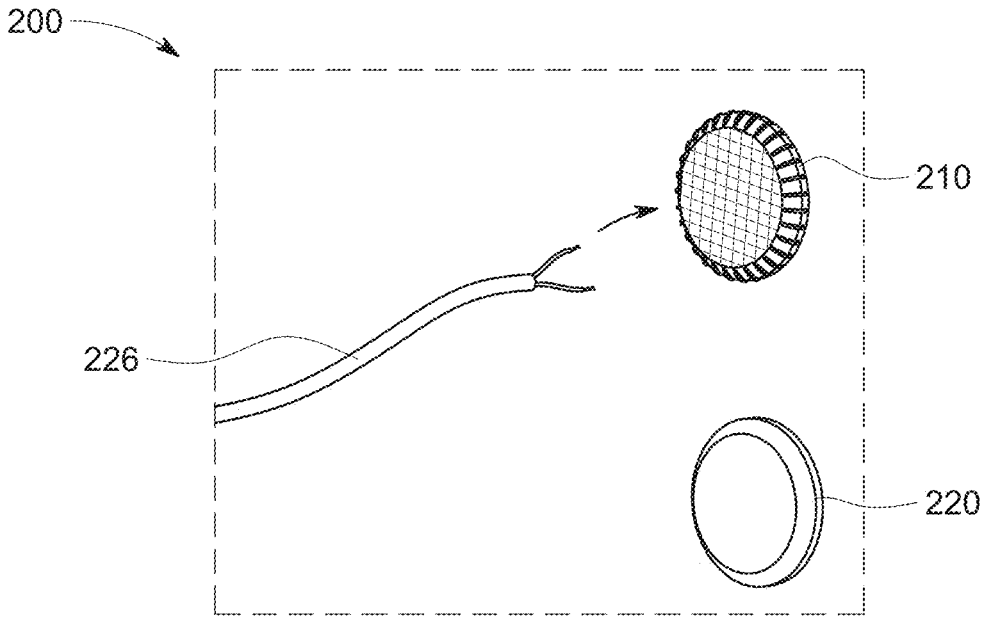
Figure 7D:
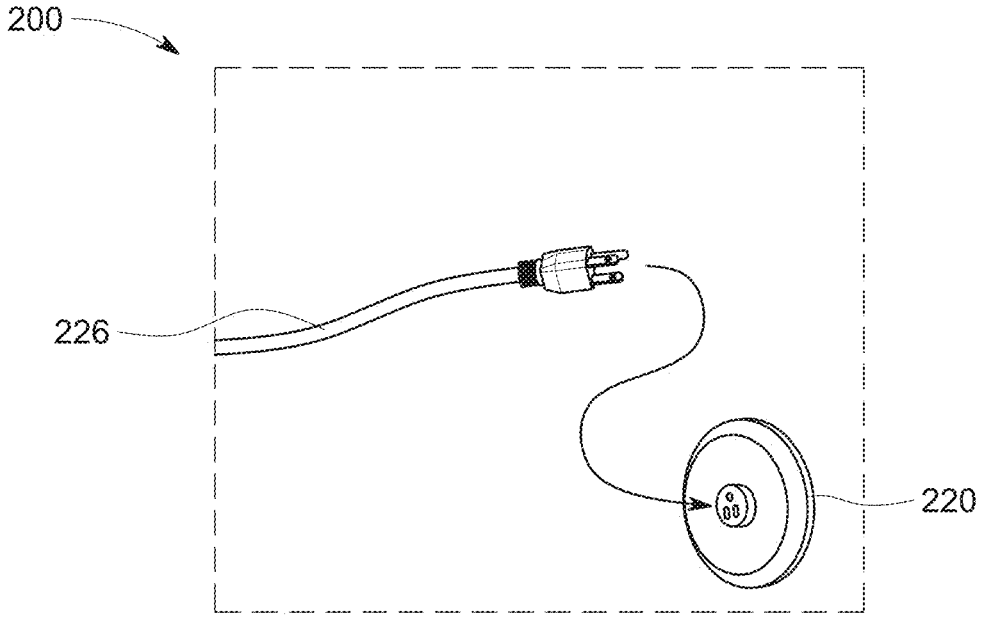
Figure 7E:
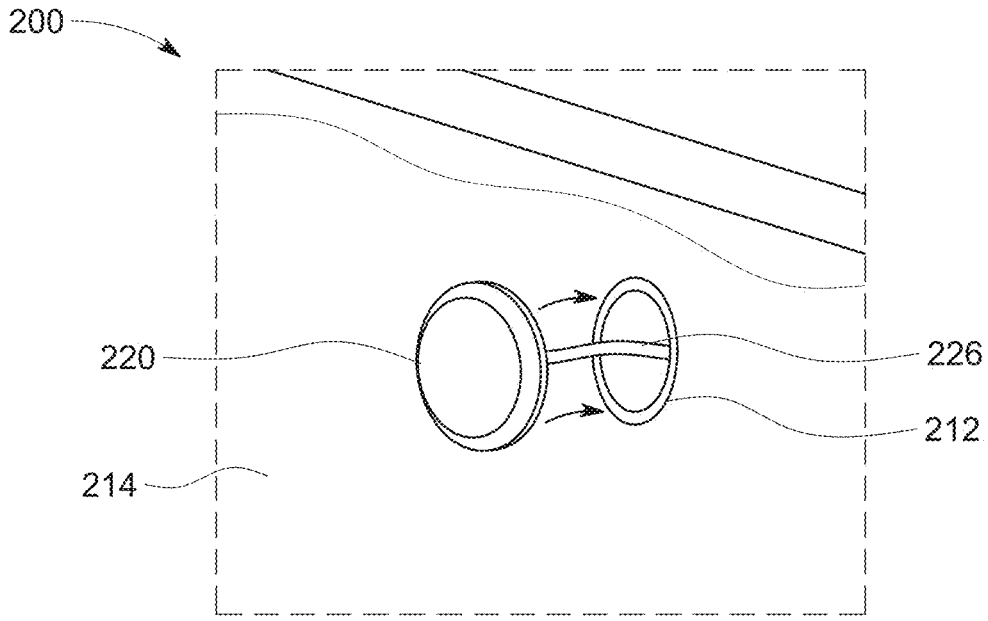
Figure 7F:
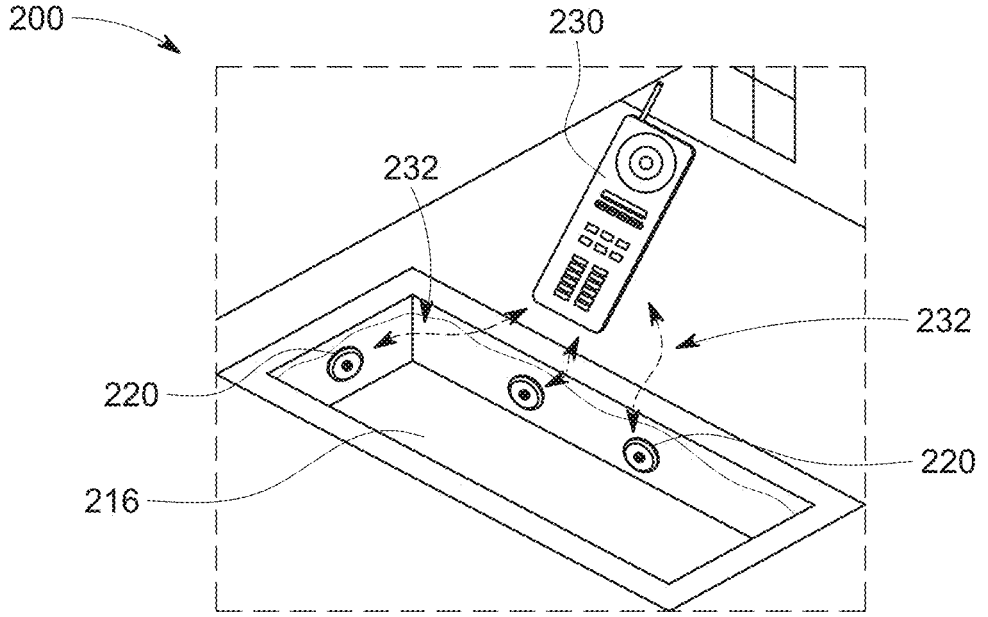

FIGS. 7A-7F are diagrammatical illustrations of a method 200 of installing and using the lighting system for use in a high-moisture environment of FIG. 3, in accordance with the first exemplary embodiment of the present disclosure. In particular, FIGS. 7A-7F depict the general steps to replacing a conventional swimming pool light with a new swimming pool light, in accordance with the subject disclosure, such that an older pool can be retrofitted with a new pool lighting system. FIG. 7A illustrates an existing conventional swimming pool light 210 within a pool wall 214. In FIG. 7B, the conventional pool light 210 has been removed from the wall housing 212 and placed on the pool deck. A wired power supply 226 is connected between the power supply (not shown) and the conventional pool light 210. In FIG. 7C, the conventional pool light 210 is disconnected from the power supply wire 226 and a new pool lighting unit 220, as described relative to FIGS. 3-6, is provided. In FIG. 7D, the existing power supply wire 226 is fitted with a plug end (or other connector) and it is connected into the back of the new pool lighting unit 220. In FIG. 7E, the new pool lighting unit 220, with wired power supply 226 attached, is reinstalled into the existing wall housing 212. Next, as shown in FIG. 7F, a mobile control unit 230 is provided which allows users to transmit a wireless control signal 232 to the new pool lighting unit 220 to wirelessly control and change a characteristic of the new lighting unit 220, such as an on/off status of the light, a color of the light, a pattern of a lighting effect, or others. The mobile control unit 230 may be used proximate to the pool 216, such that the wireless control signal 232 passes, at least partially, through water within the pool 216. Any number of additional steps, variations, functions, or alterations may be included with the method 200, including any disclosed relative to any figure of this disclosure.

Figure 8:
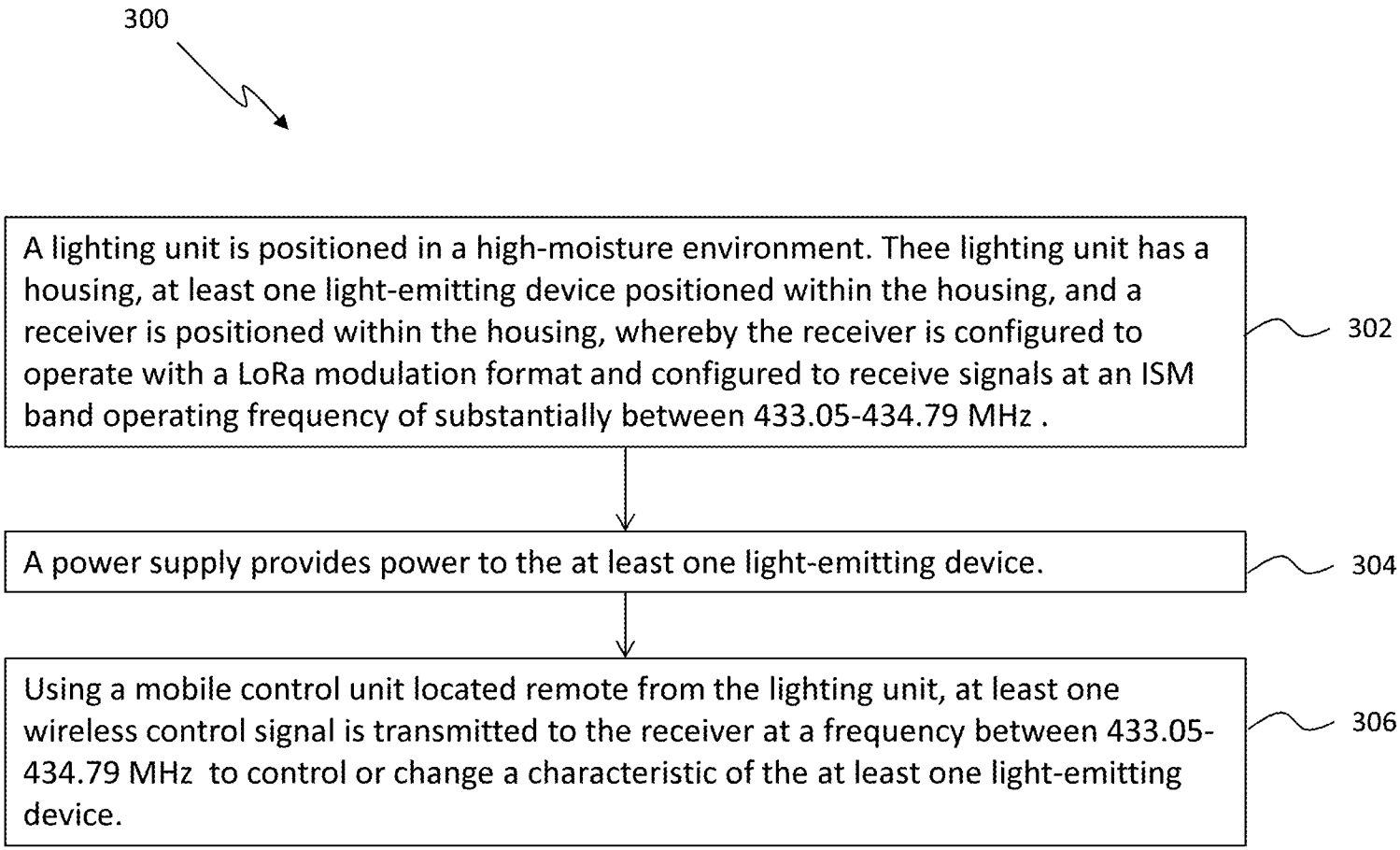
FIG. 8 is a flowchart illustrating a method of installing the lighting system for use in a high-moisture environment of FIG. 3, in accordance with the first exemplary embodiment of the present disclosure.

FIG. 8 is a flowchart illustrating a method 300 of installing the lighting system for use in a high-moisture environment of FIG. 3, in accordance with the first exemplary embodiment of the present disclosure. It should be noted that any process descriptions or blocks in flow charts should be understood as representing modules, segments, portions of code, or steps that include one or more instructions for implementing specific logical functions in the process, and alternate implementations are included within the scope of the present disclosure in which functions may be executed out of order from that shown or discussed, including substantially concurrently or in reverse order, depending on the functionality involved, as would be understood by those reasonably skilled in the art of the present disclosure.

As shown at block 302, a lighting unit is positioned in a high-moisture environment. The lighting unit has a housing, at least one light-emitting device positioned within the housing, and a receiver is positioned within the housing, whereby the receiver is configured to operate with a Long Range (LoRa) modulation format and configured to receive signals at an ISM band operating frequency of substantially between 433.05-434.79 MHz. A power supply provides power to the at least one light-emitting device (block 304). Using a mobile control unit located remote from the lighting unit, at least one wireless control signal is transmitted to the receiver at a frequency between 433.05-434.79 MHz to control or change a characteristic of the at least one light-emitting device (block 306). The method 300 may include any number of additional steps, variations, functions, or alterations, including any disclosed relative to any figure of this disclosure.

It should be emphasized that the above-described embodiments of the present disclosure, particularly, any "preferred" embodiments, are merely possible examples of implementations, merely set forth for a clear understanding of the principles of the disclosure. Many variations and modifications may be made to the above-described embodiment(s) of the disclosure without departing substantially from the spirit and principles of the disclosure. All such modifications and variations are intended to be included herein within the scope of this disclosure and the present disclosure and protected by the following claims.

What is claimed is:

1. A lighting system for use in a high-moisture environment, the lighting system comprising:

a lighting unit positioned in the high-moisture environment, the lighting unit having a housing and at least one light-emitting device positioned within the housing;

a power supply providing power to the at least one light-emitting device;

a receiver positioned within the housing, the receiver operating with a Long Range (LoRa) modulation format; and a mobile control unit located remote from the lighting unit, the mobile control unit is configured to transmit at least one wireless control signal directly to the receiver, and without transmission through an intermediary control unit, whereby the at least one control signal controls or changes a characteristic of the at least one light-emitting device.

2. The lighting system of claim 1, wherein the high-moisture environment further comprises at least one of: a swimming pool, a spa, a shower, a sauna, a bathtub, and a recreational water structure.

3. The lighting system of claim 1, wherein the housing of the lighting unit is formed in a concrete wall of a structure at least partially enclosing the high-moisture environment.

4. The lighting system of claim 1, wherein the at least one light-emitting device further comprises a light-emitting diode (LED) lamp having at least four colors, wherein the four colors comprise: white, red, green, and blue.

5. The lighting system of claim 1, wherein the at least one light-emitting device further comprises an induction light-emitting device having an induction transmitter and an induction receiver.

6. The lighting system of claim 1, wherein the characteristic of the at least one light-emitting device further comprises at least one of: an on/off state, a color, a light effect, or a pattern of display.

7. The lighting system of claim 1, wherein the at least one wireless control signal transmitted to the receiver is transmitted at least partially through a quantity of water.

8. The lighting system of claim 1, wherein with the exception of a wired power supply connection, the housing of the lighting unit is free from external wired connections thereto.

9. A lighting system for use in a swimming pool holding a quantity of water, the lighting system comprising:

a lighting unit having a housing and at least one light-emitting device positioned within the housing, the housing embedded within a concrete wall of the swimming pool;

a wired power supply providing power to the at least one light-emitting device, wherein the wired power supply extends at least partially through the concrete wall of the swimming pool;

a receiver positioned within the housing, the receiver operating with a Long Range (LoRa) modulation format; and a mobile control unit located remote from the lighting unit, wherein the mobile control unit transmits at least one wireless control signal directly to the receiver, and without transmission through an intermediary control unit to change a characteristic of the at least one light-emitting device, wherein the characteristic of the at least one light-emitting device further comprises at least one of: an on/off state, a color, a lighting effect, or a pattern of display.

10. The lighting system of claim 9, wherein the at least one light-emitting device further comprises a light-emitting diode (LED) lamp having at least four colors, wherein the four colors comprise: white, red, green, and blue.

11. The lighting system of claim 9, wherein the at least one light-emitting device further comprises an induction light-emitting device having an induction transmitter and an induction receiver.

12. The lighting system of claim 9, wherein the at least one wireless control signal transmitted to the receiver is transmitted at least partially through a quantity of water.

13. The lighting system of claim 9, wherein with the exception of a wired power supply connection, the housing of the lighting unit is free from external wired connections thereto.

14. A method of installing a lighting system for use in a high-moisture environment, the method comprising the steps of:

positioning a lighting unit in the high-moisture environment, the lighting unit having a housing, at least one light-emitting device positioned within the housing, and a receiver is positioned within the housing, whereby the receiver is configured to operate with a Long Range (LoRa) modulation format;

providing a power supply to power the at least one light-emitting device; and using a mobile control unit located remote from the lighting unit, transmitting at least one wireless control signal directly to the receiver, and without transmission through an intermediary control unit to control or change a characteristic of the at least one light-emitting device.

15. The method of claim 14, wherein the high-moisture environment further comprises at least one of: a swimming pool, a spa, a shower, a sauna, a bathtub, and a recreational water structure.

16. The method of claim 14, wherein the at least one light-emitting device further comprises a light-emitting diode (LED) lamp having at least four colors, wherein the four colors comprise: white, red, green, and blue.

17. The method of claim 14, wherein the characteristic of the at least one light-emitting device further comprises at least one of: an on/off state, a color, a pulse timing, or a pattern of display.

18. The method of claim 14, further comprising transmitting the at least one wireless control signal to the receiver at least partially through a quantity of water.

19. The method of claim 14, wherein with the exception of a wired power supply connection, the housing of the lighting unit is free from external wired connections thereto.

20. The method of claim 14, further comprising the step of removing an existing light from the high-moisture environment prior to positioning the lighting unit in the high-moisture environment.

* * * * *